US006239083B1

(12) United States Patent
Muir

(10) Patent No.: US 6,239,083 B1
(45) Date of Patent: May 29, 2001

(54) CLARIFICATION METHOD FOR OIL DISPERSIONS COMPRISING OVERBASED DETERGENTS CONTAINING CALCITE

(75) Inventor: Ronald J. Muir, West Hill (CA)

(73) Assignee: Crompton Corporation, Greenwich, CT (US)

( * ) Notice: Subject to any disclaimer, the term of this patent is extended or adjusted under 35 U.S.C. 154(b) by 0 days.

(21) Appl. No.: 09/586,011

(22) Filed: Jun. 2, 2000

(51) Int. Cl.[7] ..... C10M 159/24
(52) U.S. Cl. ..... 508/393
(58) Field of Search ..... 508/393

(56) References Cited

U.S. PATENT DOCUMENTS

| | | | |
|---|---|---|---|
| 3,242,079 | 3/1966 | McMillen | 252/33 |
| 3,376,222 | 4/1968 | McMillen | 252/33 |
| 4,086,170 | 4/1978 | De Clippeleir et al. | 252/33 |
| 4,427,559 | 1/1984 | Whittle | 252/33 |
| 4,560,489 | 12/1985 | Muir et al. | 252/33.4 |
| 4,597,880 | 7/1986 | Eliades | 252/33 |
| 4,604,219 | 8/1986 | Whittle | 252/25 |
| 4,780,224 | 10/1988 | Jao | 252/25 |
| 4,824,584 | 4/1989 | Muir et al. | 252/33 |
| 4,865,754 | 9/1989 | Chang | 252/39 |
| 4,981,603 | 1/1991 | Demange | 252/33 |
| 4,995,993 | 2/1991 | Papke et al. | 252/25 |
| 4,997,584 | 3/1991 | Jao et al. | 252/33 |
| 5,049,290 | 9/1991 | Emert et al. | 252/32.7 |
| 5,308,514 | 5/1994 | Olson et al. | 252/18 |
| 5,338,467 | 8/1994 | Olson et al. | 252/33 |
| 6,107,259 * | 8/2000 | Muir et al. | 508/393 |

FOREIGN PATENT DOCUMENTS

| | | |
|---|---|---|
| 0 493 933 A1 | 12/1991 | (EP) . |
| 00/04113 | 1/2000 | (WO) . |

OTHER PUBLICATIONS

J.L. Mansot, et al., Colloids and Surfaces A: Physico Chemical and Engineering Aspects, 75 (1993), pp. 25–31.

* cited by examiner

*Primary Examiner*—Jacqueline V. Howard
(74) *Attorney, Agent, or Firm*—Dan Reitenbach, Esq.

(57) ABSTRACT

A hazy dispersion of a calcite-containing sulfonate detergent in oil is clarified by a process including the steps of:

a) adding to the dispersion at least one acidifying compound selected from the group consisting of carbon dioxide; sulfur dioxide; organosulfonic acids having a molecular weight of at least 350; and organic carboxylic acids, diacids and anhydrides, containing at least 7 carbon atoms, b) reacting the dispersion in the presence of the acidifying compound, water, and at least one volatile organic solvent, and c) removing volatiles from the so-reacted dispersion by vaporization.

12 Claims, No Drawings

CLARIFICATION METHOD FOR OIL DISPERSIONS COMPRISING OVERBASED DETERGENTS CONTAINING CALCITE

FIELD OF THE INVENTION

This invention relates to oil formulations employing overbased detergents containing calcite and to the method of clarifying such oil formulations.

BACKGROUND OF THE INVENTION

Among the materials that impart detergency to lubricating oils to keep internal engine parts clean and reduce sludge formation in the oil are overbased detergents, particularly calcium sulfonates. These sulfonates are known to be useful as additives for lubricating oils, particularly as a crankcase engine oil for internal combustion engines.

Overbased calcium sulfonates are generally produced by carbonating a mixture of hydrocarbons, sulfonic acid, calcium oxide or calcium hydroxide and promoters such as methanol and water. In carbonation, the calcium oxide or hydroxide reacts with the gaseous carbon dioxide to form calcium carbonate. The sulfonic acid is neutralized with an excess of CaO or Ca(OH), to form the sulfonate. The prior art known processes for overbasing calcium sulfonates produce high alkaline reserves of TBN of 300 to 400 mg KOH/gm or higher, which enables the formulator to use lower amounts of additive while maintaining equivalent detergency to protect the engine adequately under conditions of high acid formation in the combustion process.

The calcium carbonate component of the overbased calcium sulfonate forms the core of a calcium sulfonate micellar structure. The calcium carbonate is either in the amorphous and/or one or more of its crystalline forms particularly, calcite.

Dispersions of non amorphous or so called crystalline calcium carbonates are generally very cloudy and highly viscous materials. These are prepared by a variety of processes such as disclosed in U.S. Pat. No. 3,242,079, U.S. Pat. No. 3,376,222, U.S. Pat. No. 4,560,489, U.S. Pat. No. 4,597,880, U.S. Pat. No. 4,824,584 and U.S. Pat. No. 5,338,467. They find limited application as rust preventative coatings, rheology modifiers, extreme pressure (EP) metal working formulations and greases. Although colloidal dispersions comprising crystalline calcium carbonate are widely used in formulating greases, they generally cannot be used in formulated engine oil lubricants because it does not give acceptably transparent formulations and it provides very high viscosities. Calcite carbonates, however, have desirable antiwear properties so that it would be advantageous to use such materials in engine lubricating oils.

The lubricating oil art, particularly as directed to automotive crankcase and other engine oils, mandates a clear or substantially haze free product for requisite consumer aesthetics and acceptance. This need precluded the use of prior art detergents with haze producing crystalline calcium carbonate.

Papke, et al., U.S. Pat. No. 4,995,993, recognized that large micellar crystalline calcium carbonate structures caused haze, and overbased sulfonate products containing crystalline calcium carbonates are always undesirable and therefore crystallization was to be avoided at all costs. See col. 4, lines 39–42 of U.S. Pat. No. 4,995,993.

In "Colloidal Anti-wear Additives 2. Tribological Behavior of Colloidal Additives in Mild Wear Regime," J. L. Mansot, et al., *Colloids and Surfaces A: Physico Chemical and Engineering Aspects*, 75 (1993), pp. 25–31, it is indicated that for certain forms of an overbased sulfonate containing an amorphous calcium carbonate core, when in a 2% by weight dispersion in dodecane, and subjected to metallic friction surfaces, the calcium carbonate forms a polycrystalline film adherent to the metallic friction surfaces, which resultantly provides anti-wear protection. Mansot, et al. thereby directed one to providing an overbased calcium sulfonate with an amorphous micellar structure which would then, under a mild wear regime, undergo transformation to microcrystalline agglomerates through an amorphous intergranular phase. Mansot, et al., in this manner, further confirmed the direction of the prior art to providing amorphous calcium carbonate micellar dispersion overbased calcium sulfonate detergents.

In WO 0004113, a process for producing soluble overbased calcite-containing detergents are described which are suitable for use in engine oil formulations. However, for many purposes it would be more advantageous to be able to use a conventionally prepared calcite-containing detergent in an engine oil formulation.

SUMMARY OF THE INVENTION

A procedure has been developed whereby an oil dispersion comprising a conventionally prepared calcite-containing detergent material can be reacted with various acidic compounds to produce clear dispersions that find utility in engine oil applications to provide multi-functional benefits including corrosion protection, antiwear and extreme pressure benefits, detergency, and friction reduction properties.

Unlike the method of WO 0004113, which utilizes a process for converting an amorphous overbased calcium sulfonate into a clear calcite-containing product, the processes of the present invention start from dispersion of conventional calcite overbased products, post-reacting the dispersion with the acidic compound in the presence of a solvent or solvent blend to form a clear dispersion.

In one aspect the invention is a process for clarifying a hazy dispersion of a calcite-containing sulfonate detergent in oil, the process comprising:

a) adding to the dispersion at least one acidifying compound selected from the group consisting of carbon dioxide; sulfur dioxide; organosulfonic acids having a molecular weight of at least 350, and organic carboxylic acids, diacids and anhydrides, containing at least 7 carbon atoms, b) reacting the dispersion in the presence of the acidifying compound, water, and at least one volatile organic solvent, and c) removing volatiles from the so-reacted dispersion by vaporization.

Another aspect of the present invention is lubricating oils produced by said process.

DETAILED DESCRIPTION OF THE INVENTION

The present invention is applicable to a wide variety of lubricating oils. The lubricating oil can be composed of one or more natural oils, one or more synthetic oils, or mixtures thereof. Natural oils include animal oils and vegetable oil (e.g., castor, lard oil), liquid petroleum oils and hydrorefined, solvent-treated or acid-treated mineral lubricating oils of the paraffinic, naphthenic and mixed paraffinic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1hexenes), poly (1-octenes), poly (1-decenes)); alkylbenzenes (e.g., dodecylbenzenes, tetradecylbenzenes, dinonylbenzenes, di(2ethylhexyl) benzenes); polyphenyls (e.g. biphenyls, terphenyls, alkylated polyphenols); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methylpolyisoprdpylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ oxo acid diester of tetraethylene glycol.

Another suitable class of synthetic lubricating oils comprises the esters of dicarboxylic acids (e.g. phthalic acid, succinic acids, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di (2-ethylhexyl ) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids, and polyols and polyol ethers such as neopentyl glycol, trimethylolpropane, pentaerythritol , dipentaerythritol, and tripentaerythritol.

Silicon-based oils such as the polyalkyl-, polyaryl-polyalkoxy-, and polyaryloxysiloxane oils and silicate oils comprise another useful class of synthetic lubricants; they include tetraethyl silicate, tetraisopropyl silicate, tetra-(2-ethyhexyl)silicate, tetra-4-methyl-2-ethylhexyl) silicate, tetra-(p-tert-butyphenyl) silicate, hexa-(4methyl-2-pentoxy) disiloxane, poly(methyl)siloxanes and poly(methylphenyl) siloxanes. Other synthetic lubricating oils include liquid esters of phosphoruscontaining acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils which have been already in service. Such rerefined oils are also known as reclaimed or reprocessed oils and often are additionally processed by techniques for removal of spent additives and oil breakdown products.

The invention is particularly directed to engine oil formulations and additives therefore. As used herein the term "engine oil" means a lubricating oil that may be useful in an engine oil, and by way of example, includes an automotive oil or diesel engine oil.

The formulated oil should have a viscosity in the lubricating viscosity range, typically about 45 SUS at 100 ° F., to about 6000 SUS at 100 ° F. The lubricating oil also contains one or more overbased alkaline earth metal detergents, at least a portion of which is a calcite-comprising sulfonate detergent modified as described herein. The detergent components collectively comprise an effective amount which usually lies in a range of 0.01 wt. % up to as much as 25 wt. %, preferably 0.1–10 wt. %, more preferably 0.1 to 5.0%. Unless indicated otherwise herein, all weight percentages are by weight of the entire lubricating oil composition.

The calcite-containing sulfonate detergent utilized in the invention may be produced from a cloudy or hazy dispersion of a calcite-containing sulfonate detergent in oil by a process comprising:

a) adding to the dispersion at least one acidifying compound selected from the group consisting of carbon dioxide; sulfuir dioxide; organosulfonic acids having a molecular weight of at least 400; and organic carboxylic acids, diacids and anhydrides, containing at least 7 carbon atoms, b) reacting the dispersion in the presence of the acidifying compound, water, and at least one volatile organic solvent, and c) removing volatiles from the so-reacted dispersion by vaporization.

The starting cloudy or hazy dispersion of a calcite-containing sulfonate detergent in oil may be a relatively high viscosity calcite-comprising sulfonate, having a calcium carbonate concentration up to about 45%, or a more dilute oil dispersion of a calcite-containing sulfonate dispersion. The dilution may be at the final desired sulfonate concentration, and formulated so that the oil may be considered finished but for the cloudiness or haze imparted by the calcite-containing sulfonate component, or at some intermediate dilution, between that of a grease and that of the lubricating oil product. Commercially available calcite-containing dispersions may be employed, such as Witco Calcinate C400W and GO26, both available from CK Witco Corp. Such products generally have a TBN (total base number per ASTM D-2896) of 100 to greater than 500, with a total strong base number (reflecting the calcium oxide and hydroxide content) of about 10 to about 80, more often about 30 to 40.

The sulfonic acids from which the calcite-containing sulfonate are derived are typically obtained by the sulfonation of alkyl substituted aromatic hydrocarbons such as those obtained from the fractionation of petroleum and/or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. Exemplary alkylating agents include haloparaffins, olefins obtained by dehydrogenation of paraffins, polyolefin polymers produced from ethylene, propylene, etc. The alkylaryl sulfonates usually contain from about 9 to about 70 or more carbon atoms per alkyl substituted aromatic moiety. Aliphatic sulfonates may also be useful since they can be overbased.

As a result of the processing in accordance with the present invention, the total strong base number of the dispersion is reduced, in the case of a detergent formulation for instance, from about 10 to 80 to about 0 to 5. The TBN of the detergent, is reduced somewhat if the acidifying compound reactant is for example a sulfonic or carboxylic acid, due to reaction to form calcium sulfonate or calcium carboxylate. However, in the event that an acidic gas such as carbon dioxide is used as the acidifying compound reactant, the TBN would remain essentially unchanged while the calcium hydroxide would be converted to calcium carbonate.

In the case of formulated lubricating oils processed in accordance with the invention or to which a detergent so processed is added, such formulated oils can also contain other conventional components such as dispersants, antioxidants, rust inhibitors, viscosity control agents, and so forth. The choice of such other components, and the amount thereof, are familiar matters to those of ordinary skill in this art.

The acidifying compound is selected from the group consisting of carbon dioxide; sulfur dioxide; organosulfonic acids having a molecular weight of at least 350, suitable at least, 400; and organic carboxylic acids, diacids, and anhydrides containing at least 7 carbon atoms; and mixtures thereof.

Suitable organic sulfonic acids can be characterized by the formula $R^1$—$SO_3H$ wherein $R^1$ is a linear or branched alkyl group, or an arylalkyl, alkylarylalkyl or alkylaryl group, wherein the aryl moiety can be phenyl or fused bicyclic such as naphthalene, indanyl, indenyl, bicyclopentadienyl, and the like. The aryl moiety can be substituted with one or more alkyl groups; a preferred example is monoalkylbenzenesulfonic acid of molecular weight about 520.

Other suitable acidifying compounds include organic carboxylic acids, diacids and anhydrides, preferably containing at least 7 to 8 carbon atoms. Suitable compounds include: straight-chain and branched alkanoic and alkenoic acids such as stearic acid and oleic acid; aryl, arylalkyl, alkylaryl, and alkylarylalkyl carboxylic acids; diacid analogs of alkanoic, alkenoic, aryl, arylalkyl, alkylaryl, and alkylarylalkyl carboxylic acids, including salicylic acid, alkylsalicylic acid, and dimer acids such as can be formed by reaction together of two ethylenically unsaturated fatty acids; and anhydrides of all such acids and diacids.

When the acidifying compound is a solid or a liquid, it can simply be added to the oil and stirred to homogeneity. Carbon dioxide or sulfur dioxide is bubbled, into the oil, using any suitable mechanism such as a sparging tube, at a rate which achieves the desired lowering of total strong base number in a given period of time. Agitation of the oil increases solids contact with the acidifying compound and lessens the time needed. Typically the addition is effected at a temperature of about 120° F. or more, preferably 135–160° F. for a period of about 2 hours to about 30 minutes.

To effectuate the reaction, water (typically an amount of about 1 to about 20% by weight of the crystalline overbased sulfonate dispersion) and at least one volatile solvent are desirably employed. Volatile solvents are those having a boiling point below about 400° F. (204° C.), at ambient pressure. Solvents such as lower ($C_1$–$C_4$) alcohols, and/or hydrocarbon solvents may be employed. Alcohol solvents may be suitably be utilized in amounts of about 1 to about 20 % of the crystalline overbased sulfonate dispersion. Hydrocarbon solvents, acting primarily as diluents, may be present in amounts as high as 70% or more. The volatile solvent(s) may be removed by heating the reacted mixture at ambient pressure to about 400° F. (204° C.) or more. A lower removal temperature can be employed at a reduced pressure. The solvent removal step may also be combined with the reacting step by gradually increasing the temperature after addition of the acidic compound, with stirring, until the temperature reaches 400° F. (204° C.) or more, or by gradually reducing the pressure after the addition until the solvent has been removed, or by a combination of such changes.

The progress of the reaction with the acidifying compound can be monitored by periodic inspection for clarity at ambient or by periodic analysis of the oil for total strong base number.

To realize appreciable lessening of the tendency to solids formation, a calcite detergent product having a total strong base number of 10 to 80 should typically be lowered in this manner to about 10 or less. Corresponding reductions in more dilute dispersions are likewise recommended. Departures from these recommendations may be viable in many cases, however, depending on other characteristics of the specific dispersion employed. In any case, the amount of reactants, timing and temperature can be monitored and adjusted in accordance with the clarity improvement obtained and desired.

The invention is illustrated by the following non-limiting examples

EXAMPLES

Examples 1–5

Comparative Examples A & B

Calcinate G026, sold by CK Witco Corp., is a calcite dispersion that is very hazy in oil.

In Examples 1–3, the G026 product was mixed at 130–145° F. with a quantity of water, solvent(s) and a sulfonic acid mixture comprising 25% by weight sulfonic acid ($RSO_3H$), 25% oil and 50% VM&P naphtha. The sulfonic acid has an equivalent weight of about 500. After all ingredients were throughly mixed, the temperature was raised over one hour to 410° F. to remove volatiles. Quantities and results are shown in Table 1.

In Examples 4–5 and in Comparative Example A, mixtures were prepared as shown in Table 1, blending at 145–155° F. with the $CO_2$ being added by bubbling for a period of 20 minutes at the indicated rate. The mixture was then taken slowly to 410° F. Results are shown in Table 1.

In Comparative Example B a mixture as shown in Table 1 at 330° F. was prepared with the indicated amount of $CO_2$ being added by bubbling for a period of 20 minutes at the indicated rate. Results are shown in Table 1.

TABLE 1

| | Invention Examples | | | | | Comparative Examples | |
|---|---|---|---|---|---|---|---|
| Components | 1 | 2 | 3 | 4 | Ex 5 | A | B |
| GO26 | 100 | 100 | 100 | 200 | 200 | 200 | 200 |
| Oil | | | | 57 | 57 | 57 | 57 |
| Sulfonic acid | 50 | 20 | 15 | | | | |
| Methanol | 10 | 6 | 6 | 50 | | | |
| Water | 10 | 6 | 6 | 50 | 50 | 50 | |
| VM&P Naphtha | 25 | | | 100 | 100 | | |
| $CO_2$ | | | | 220 cc/min for 20 min | same | same | same |
| Solubility | C | C | C | C | C | H | H |

C = clear
H = hazy

The results show that both the sulfonic acid and the carbonation treatment can be used to produce a clear dispersion product but that carbonating without water and/or solvent was not effective.

Example 6

In a manner similar to Examples 1–3, another hazy commercial crystalline calcite dispersion sold by CK Witco Corp. as Calcinate C400W was reacted with a sulfonic acid of MW~500 with linear alkyl substitution, in presence of water and methanol, followed by dehydration at an elevated temperature. The initial crystalline calcite reactant was cloudy in oil and wholly unsuitable as an engine oil additive due to its appearance and oil insolubility. The result after processing in accordance with the invention was a bright and clear calcite dispersion which was soluble in base oils including poor solvency bright stock fractions.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto. Further, the specific features recited in the respective dependent claims can be combined in any other manner with the features of the independent claims and any of the other dependent claims, and all such combinations are expressly contemplated to be within the scope of the invention.

Throughout the specification and claims the term "comprises" is defined as "includes," i.e. without limiting additional subject matter which may be added thereto, and the various derivatives of the term (for instance "comprising") are defined correspondingly.

All published documents, including all US patent documents, mentioned anywhere in this application are hereby expressly incorporated herein by reference in their entirety. Any copending patent applications, mentioned anywhere in this application are also hereby expressly incorporated herein by reference in their entirety.

What is claimed is:

1. A process for clarifying a hazy dispersion of a calcite-containing sulfonate detergent in oil, the process comprising:

a) adding to the dispersion at least one acidifying compound selected from the group consisting of carbon dioxide; sulfur dioxide; organosulfonic acids having a molecular weight of at least 350; and organic carboxylic acids, diacids and anhydrides, containing at least 7 carbon atoms, b) reacting the dispersion in the presence of the acidifying compound, water, and at least one volatile organic solvent, and c) removing volatiles from the so-reacted dispersion by vaporization.

2. A process as in claim 1 wherein the volatile solvent is selected from the group consisting of lower ($C_1$–$C_4$) alcohols and hydrocarbon solvents having a boiling point of about 400° F. (204° C.) or less.

3. A process as in claim 1 wherein the reacting step b) is conducted at a temperature of 70° F. (21° C.) or more.

4. A process as in claim 1 wherein the volatiles are removed by heating to at least 400° F. (204° C.) at ambient pressure.

5. A process as in claim 1 wherein the calcite-containing sulfonate has a TBN of from 50 to about 400.

6. A process as in claim 1 wherein the acidifying compound is carbon dioxide.

7. A process as in claim 1 wherein the acidifying compound is an organosulfonic acid having a molecular weight of at least 350.

8. A process as in claim 1 wherein the dispersion is an engine oil formulation comprising from about 0.1 to 5.0% of said sulfonate detergent.

9. An engine oil comprising a clarified dispersion of a calcite-containing sulfonate detergent prepared by the process of claim 8.

10. An oil dispersion comprising a clarified dispersion of a calcite-containing sulfonate detergent prepared by the process of claim 1.

11. A lubricating oil formulated as an automobile engine crankcase oil and comprising an oil dispersion as in claim 10.

12. lubricating oil formulated as a diesel engine oil and comprising an oil dispersion as in claim 10.

* * * * *